United States Patent [19]

Saito et al.

[11] Patent Number: 4,987,030

[45] Date of Patent: Jan. 22, 1991

[54] HIGH-TENACITY CONJUGATED FIBER AND PROCESS FOR PREPARATION THEREOF

[75] Inventors: Isoo Saito; Takuji Sato, both of Okazaki; Koichi Kubota, Aichi; Masaharu Yamamoto, Nagoya, all of Japan

[73] Assignee: Toray Industries, Inc., Tokyo, Japan

[21] Appl. No.: 253,135

[22] Filed: Oct. 4, 1988

[30] Foreign Application Priority Data

Oct. 7, 1987 [JP] Japan ..... 62-253125
Oct. 7, 1987 [JP] Japan ..... 62-253126

[51] Int. Cl.[5] ..... D02G 3/00

[52] U.S. Cl. ..... 428/373; 57/902; 478/374; 264/171; 264/210.8

[58] Field of Search ..... 428/373, 374, 401; 57/902; 264/171, 210.8; 152/359

[56] References Cited

U.S. PATENT DOCUMENTS

| | | | |
|---|---|---|---|
| 3,975,351 | 8/1976 | Etchells | 428/373 |
| 4,195,052 | 3/1980 | Davis | 264/235 X |
| 4,496,630 | 1/1985 | Kurita et al. | 264/210.7 X |
| 4,504,545 | 3/1985 | Kurita et al. | 264/210.8 X |
| 4,851,508 | 7/1989 | Kurita et al. | 264/210.8 X |

*Primary Examiner*—Lorraine T. Kendell
*Attorney, Agent, or Firm*—Austin R. Miller

[57] ABSTRACT

A conjugated fiber having a sheath-core conjugated structure comprising a polyester core component composed mainly of polyethylene terephthalate and a polyamide sheath component composed mainly of polyhexamethylene adipamide, is disclosed, which has excellent mechanical properties such as a high tenacity, a high modulus, and an improved dimensional stability, and an improved adhesion to a rubber, especially a high-temperature adhesion, an improved heat resistance in a rubber, and a high fatigue resistance, and thus is useful as an industrial material. By adopting a high-speed spinning procedure in the fiber preparing process, the peel resistance in the interface of the sheath-core conjugated structure is greatly improved, and the following valuable characteristics not possessed by conventional conjugated yarns can be obtained:

(1) Excellent adhesion and high-temperature adhesion comparable to those of a polyamide, which cannot be obtained in a polyester.

(2) High modulus and dimensional stability comparable to those of a polyester, which cannot be obtained in a polyamide.

(3) A heat resistance in a rubber and a fatigue resistance superior to those of a polyester.

4 Claims, No Drawings

HIGH-TENACITY CONJUGATED FIBER AND PROCESS FOR PREPARATION THEREOF

BACKGROUND OF THE INVENTION (1) Field of the Invention

The present invention relates to a hightenacity conjugated fiber having excellent durability and suitable for industrial uses, especially as a rubber reinforcement. More particularly, the present invention relates to a conjugated fiber for industrial uses, which has excellent mechanical properties such as a high tenacity, a high modulus and improved dimensional stability, and improved adhesion to rubber, especially high-temperature adhesion, good heat resistance in high-temperature rubber, and improved fatigue resistance.

(2) Description of the Related Art

Polyester fibers represented by polyethylene terephthalate fibers are widely utilized for various industrial purposes because they are characterized by high tenacity and high elastic modulus, and these fibers are advantageously used as rubber reinforcements such as tire cords, transmission belts and conveyor belts.

Nevertheless, polyester fibers have poor heat resistance when embedded in rubber. Namely, at high temperature, ester bonds of polyester fibers are broken by the action of water or an amine compound contained in rubber, resulting in degradation of tenacity. Furthermore, polyester fibers have a poor adhesion to rubber, and when the polyester fibers are repeatedly exposed to high-temperature atmosphere for a long time, a problem such as drastic degradation of the adhesion to a rubber arises.

Tire cords composed of polyester fibers have been used in large quantities as carcass cords of radial tires for passenger cars, where the characteristics of high tenacity and high modulus are utilized. But when these tire cords are used for larger vehicles such as vans, trucks and buses, since the heat generated during running is easily accumulated in the tire, the tenacity is reduced by thermal degradation and the adhesion to rubber is lost, resulting in peeling. Accordingly, the heat resistance of polyesters in rubber must be improved to increase the adhesion at high temperature.

Many attempts to improve poor adhesion, a defect of polyester fibers, have been made, and in one of these attempts, a method was proposed in which the surface of polyester is covered with a polyamide. For example, Japanese Unexamined Patent Publication No. 49-85315 discloses a process for the preparation of a conjugated yarn comprising a polyester core and a nylon 6 sheath, in which the polymerization degrees of the constituent polymers and the ratio of the core polymer are specified and spinning is carried out by applying a non-humid lubricant and carrying out a direct spin-drawing. Furthermore, Japanese Unexamined Patent Publication No. 56-140128 discloses a rubber reinforcement composed of a sheath-core type conjugated fiber having a polyester core and a polyamide sheath, in which the ratio of the polyamide sheath component is 7 to 30% by weight and an epoxy adhesive is applied to the surface of the polyamide sheath component.

In the sheath-core type conjugated yarns proposed in Japanese Unexamined Patent Publication No. 49-85315 and Japanese Unexamined Patent Publication No. 56-140128, the adhesion to rubber is improved by the polyamide component as the sheath and the modulus or dimensional stability is maintained at a high level by the polyester component as the core. Namely, the adhesion is sufficiently improved according to this process, but the modulus and dimensional stability are degraded with an increase of the amount of the polyamide component as the sheath, and thus it is impossible to retain the satisfactory modulus and dimensional stability inherently possessed by the polyester fiber. Moreover, the heat resistance in rubber, the fatigue resistance, and other characteristics possessed by the polyamide component, are not sufficiently utilized.

Since the compatibility between an ordinary polyester such as polyethylene terephthalate and an ordinary polyamide such as nylon 6 or nylon 66 is poor if a conjugated fiber is prepared according to the usual spinning method, peeling or stripping often occurs at the polymer interface of the sheath-core conjugated structure, and the conjugated fiber does not have fatigue resistance sufficient for practical applications. Especially, the polymer interface is destroyed by the repeated elongation-compression fatigue undergone by the fibers at the drawing step, the tire cord-processing step such as the twisting or dipping step, the tire-curing step, and during running, and thus the required performances cannot be obtained from the sheath-core conjugated fiber.

SUMMARY OF THE INVENTION

A primary object of the present invention is to solve the foregoing problems and provide a conjugated fiber suitable as a rubber reinforcement, having an excellent adhesion to rubber, a high modulus and a high dimensional stability, when compared to those of a polyester, and an improved heat resistance and fatigue resistance in rubber. Especially, the present invention provides a conjugated fiber having a high modulus and an improved dimensional stability that cannot be obtained by conventional techniques, an improved heat resistance in rubber, and a satisfactory resistance to peeling and stripping of the polymers at the sheath-core interface boundary.

In accordance with the present invention, there is provided a high-tenacity conjugated fiber having a sheath-core conjugated structure consisting essentially of a polyester composed mainly of ethylene terephthalate units as the core component and a polyamide as the sheath component, wherein the ratio of the core component to the sum of the core component and sheath component is 30 to 90% by weight, and the conjugated fiber has (a) a dynamic elasticity ($E'_{20}$) at 20° C. of at least $8\times10^4$ dyne/denier and a dynamic elasticity ($E'_{150}$) at 150° C. of at least $3\times10^4$ dyne/denier, as measured at 110 Hz, and a main dispersion peak temperature ($T\alpha$) of at least 140° C. in the mechanic loss tangent (tan $\delta$) curve, (b) a creep rate ($CR_{150}$) not larger than 2.0% as measured at 20° C. after 48 hours' standing under a load of 1 g/denier and a creep rate ($CR_{150}$) not larger than 3.0% as measured at 150° C. after 48 hours' standing under a load of 1 g/denier, (c) an intrinsic viscosity ([$\eta$]) of at least 0.8 and a birefringence ($\Delta n$) of $160\times10^{-3}$ to $190\times10^{-3}$ in the polyester core component, and (d) a sulfuric acid relative viscosity ($\eta r$) of at least 2.8 and a birefringence ($\Delta n$) of at least $50\times10^{31\,3}$ in the polyamide sheath component.

In the high-tenacity conjugated fiber of the present invention, preferably, the polyester core component has a density ($\rho$) of at least 1.395 g/cm$^3$ and the polyamide sheath component has a density ($\rho$) of at least 1.135 g/cm$^3$. The polyester core component preferably has an initial modulus in tension (Mi) of at least 90 g/denier and a terminal modulus in tension (Mt) not larger than 20 g/denier. Furthermore, the high-tenacity conjugated fiber of the present invention preferably has a tenacity (T/D) of at least 7.5 g/denier, an initial tensile resistance (Mi) of at least 60 g/denier, and a dry heat shrinkage ($\Delta S_{150}$) as measured at 150° C. not larger than 7%.

The high-tenacity conjugated fiber of the present invention can be prepared according to a process which comprises forming, by melt spinning, a sheath-core high-tenacity conjugated fiber having a core formed of a polymer composed substantially of high-polymerizationdegree polyethylene terephthalate having an intrinsic viscosity ([$\eta$]) of at least 0.80 and a sheath formed of a high-polymerization-degree polyamide polymer having a sulfuric acid relative viscosity of at least 2.8, in which the ratio of the core component to the sum of the core component and sheath component is 30 to 90% by weight, said process being characterized in that a molten polymer fiber extruded from a spinneret is passed through an atmosphere, a portion of which over a length of at least 10 cm below the spinneret is maintained at a temperature of at least 200° C.; the molten polymer fiber is rapidly cooled to be solidified; an oiling agent is applied to the solidified polymer fiber; the fiber is taken up at a speed of at least 1,500 m/min to form an undrawn fiber in which the polyamide sheath component has a birefringence of $25\times10^{-3}$ to $40\times10^{-3}$ and the 20 polyester core component has a birefringence of $25\times20\times10^{-3}$ to $70\times10^{-3}$; and the undrawn fiber is subjected to multi-stage drawing including at least two stages.

DESCRIPTION OF THE PREFERRED EMBODIMENTS

The conjugated fiber of the present invention has the above-mentioned structure, and the intended maintenance of the modulus and dimensional stability at levels comparable to those of a polyester, that cannot be obtained by conventional techniques, and the intended improvement of the heat resistance and fatigue resistance in a rubber and the resistance to peeling and stripping of the polymers at the sheath-core interface can be obtained by the combination of the specific birefringences, densities, and other characteristics of the polyester as the core component and the polyamide as the sheath component. The completion of the intended fiber structure in the present invention is supported by the peculiar dynamic viscoelasticity behavior and low creep rate of the conjugated fiber of the present invention.

The respective constituent elements of the present invention and the functional effects thereof will now be described in detail.

The core component of the conjugated fiber of the present invention consists essentially of a polyester composed mainly of ethylene terephthalate units. The polyester may contain units derived from a comonomer in an amount not causing substantial degradation of the physical and chemical properties of the polyethylene terephthalate polymer, for example, in an amount of up to 10% by weight. As the comonomer component, there can be mentioned dicarboxylic acids such isophthalic acid, naphthalene-dicarboxylic acid and diphenyl-dicarboxylic acid, diols such as propylene glycol and butylene glycol, and ethylene oxide. To attain a tenacity of at least 7.5 g/denier in the conjugated fiber of the present invention, the polyethylene terephthalate fiber as the core component must have an intrinsic viscosity [$\eta$] of at least 0.8, preferably at least 0.9. To obtain an excellent heat resistance in rubber to the conjugated fiber of the present invention, preferably the concentration of the terminal carboxyl group in the polyester as the core component is not larger than 20 eq/$10^6$ g.

As the polyamide used as the sheath component, there can be mentioned ordinary polyamides such as polycapramide, polyhexamethylene adipamide, polytetramethylene adipamide, polyhexamethylene sebacamide and polyhexamethylene dodecamide. A blend or copolymer of two or more thereof can be used. Among the above, polyhexamethylene adipamide is especially preferred. To obtain the high-tenacity conjugated fiber of the present invention, the polyamide as the sheath component must also have a high degree of polymerization. Namely, the sulfuric acid relative viscosity ($\eta r$) of the polyamide must be at least 2.8, preferably at least 3.0. Preferably, a cupric salt or other organic or inorganic compound is incorporated as a heat stabilizer in the polyamide component. Usually, 30 to 500 ppm as copper of a cupric salt such as cupric iodide, cupric acetate, cupric chloride or cupric stearate, 0.01 to 0.5% by weight of an alkali metal halide such as potassium iodide, sodium iodide or potassium bromide and/or 10 to 500 ppm as phosphorus of an organic or inorganic phosphorus compound can be incorporated.

The ratio of the core component in the conjugated fiber of the present invention is 30 to 90% by weight. If the ratio of the core component is lower than 30% by weight, it is difficult to maintain the modulus and dimensional stability of the conjugated fiber at levels comparable to those of the polyester. If the ratio of the polyester core component exceeds 90% by weight, the adhesion of the conjugated fiber to rubber and the heat resistance in rubber are not sufficiently improved, and attainment of the intended effects of the present invention cannot be properly obtained.

The conjugated fiber of the present invention is characterized in that either the polyester core fiber or the polyamide sheath fiber is highly orientated and crystallized. More specifically, the birefringence ($\Delta n$) of the polyester core component fiber is $160\times10^{-3}$ to $190\times10^{-3}$. If the birefringence is lower than $160\times10^{-3}$, a tenacity (T/D) of at least 7.5 g/denier and an initial tensile resistance (Mi) of at least 60 g/denier cannot be obtained in the conjugated fiber. On the other hand, if the birefringence exceeds $190\times10^{-3}$, the dimensional stability and fatigue resistance cannot be improved. The conjugated fiber prepared by the novel process of the present invention, described hereinafter, usually, has a birefringence not larger than $190\times10^{-3}$.

The polyamide component fiber constituting the sheath is highly orientated so that the birefringence ($\Delta n$) is at least $50\times10^{-3}$, usually at least $55\times10^{-3}$. If the birefringence is lower than $50\times10^{-3}$, a conjugated fiber having a high tenacity and a high initial modulus in tension cannot be obtained.

The measurement of the birefringence ($\Delta n$) of the core sheath conjugated fiber can be carried out in the following manner. More specifically, the birefringence of the sheath is directly measured by a transmission interference microscope, and in the measurement of the birefringence of the core component, only the core polyester component fiber is sampled by dissolving the polyamide of the sheath component by hydrochloric acid, formic acid, sulfuric acid or fluorinated alcohol, and the birefringence of the core component is measured by a transmission interference microscope or by the usual Berek compensator method.

In the conjugated fiber of the present invention, the polyester as the core component has a density ($\eta$) of at least 1.395 g/cm$^3$ and the polyamide as the sheath component has a density ($\eta$) of at least 1.135 g/cm$^3$, and both the components are highly crystallized. If the densities are lower than the above-mentioned critical levels, the dimensional stability, the fatigue resistance and the heat resistance in a rubber are improved to only a minor degree in the conjugated fiber.

The density ($\eta$) of the polyester as the core component is measured after removing the polyamide by dissolution in hydrochloric acid, formic acid, sulfuric acid or fluorinated alcohol. The density of the polyamide as the component of the sheath can be calculated from the density of the conjugated fiber, the density of the polyester component, and the conjugation ratio.

The above-mentioned structural features of the conjugated fiber of the present invention are supported by a specific dynamic viscoelasticity behavior and a low creep rate. More specifically, the elasticities ($E'_{20}$ and $E'_{150}$) at 20° C. and 150° C. of the conjugated fiber of the present invention as measured at 110 Hz are at least $8\times10^4$ dyne/denier and at least $3\times10^4$ dyne/denier, respectively. The dynamic elasticity at 20° C. of the conjugated fiber of the present invention is somewhat lower than that of the polyester fiber, and varies depending upon the content of the polyamide component. At a higher temperature of 150° C., the dynamic elasticity of the conjugated fiber of the present invention is comparable to or higher than that of the polyester fiber. Of course, the dynamic elasticities of the conjugated fiber of the present invention are much higher than the dynamic elasticities ($E'_{20}$ and $E'_{150}$) at 20° C. and 150° C. of the nylon 66 fiber, which are about $6\times10^4$ dyne/denier and about $1.5\times10^4$ dyne/denier, respectively. The main dispersion peak temperature ($T\alpha$) in the mechanic loss tangent (tan $\delta$) curve of the conjugated fiber of the present invention is at least 140° C. This value is larger than the value of nylon 66, that is, about 125° C., and is comparable to or larger than the value of the polyester fiber. The above-mentioned viscoelasticity behavior cannot be explained only by combining the behaviors of the conventional polyester fiber and polyamide fiber and it is considered that this specific viscoelasticity behavior is due to the peculiar effect manifested by conjugating both the polymer components according to the present invention.

In the conjugated fiber of the present invention, the creep rates ($CR_{20}$) and ($CR_{150}$) as measured at 20° C. and 150° C. after 48 hours' standing under a load of g/denier are not larger than 2.0% and not larger than 3.0%, respectively.

Although the creep rates ($CR_{20}$) and ($CR_{150}$) at 20° C. and 150° C. of nylon 66 fibers are about 5% and about 4.5%, respectively, the creep rates ($CR_{20}$) and ($CR_{150}$) at 20° C. and 150° C. of the conjugated fiber of the present invention are about 1.5% and about 2.5%, regardless of the conjugation ratio. These values are substantially comparable to those of the polyester fiber, and the value at a high temperature of 150° C. is lower than that of the polyester fiber.

The conjugated fiber of the present invention is characterized in that, although a considerable amount of the polyamide component is contained, the presence of the polyamide component is not manifested in connection with the creep characteristics. This creep behavior of the conjugated fiber of the present invention cannot be explained only by combining the characteristics of the conventional polyester fiber and polyamide fiber, and it is considered that this specific creep behavior is due to the specific effect manifested by conjugating both the polymer components according to the present invention.

The conjugated fiber of the present invention characterized by the above-mentioned fiber structure preferably has a tenacity of at least 7.5 g/denier, an initial modulus in tension of at least 60 g/denier and a dry heat shrinkage ($\Delta S_{150}$) not larger than 7% as measured at 150° C. More preferable conjugated fiber characteristics are a tenacity of at least 8 g/denier, an initial modulus in tension of at least 70 g/denier and a dry heat shrinkage ($\Delta S_{150}$) not larger than 5%, and these characteristics can be obtained by appropriately combining the above-mentioned structural characteristics.

The conjugated fiber of the present invention having the above-mentioned characteristics is prepared according to the following novel process.

To prepare the polyester core fiber having the above-mentioned physical properties, it is necessary to use a polymer composed substantially of polyethylene terephthalate having an intrinsic viscosity ([$\eta$]) of at least 0.80, usually at least 0.85. To obtain a fiber having excellent heat resistance, preferably a polymer having a low terminal carboxyl group concentration is spun. For example, a low-temperature polymerization method or a method in which a blocking agent is added at the polymerization or spinning step can be adopted. As the blocking agent, there can be used, for example, oxazolines, epoxides, carbodiimides, ethylene carbonate, oxalic acid esters and maloic acid esters.

The polyamide used as the sheath component is a high-polymerization-degree polymer having a sulfuric acid relative viscosity of at least 2.8, usually at least 3.0. In general, a heat stabilizer as mentioned above is added at the polymerization or spinning step.

Two extruder type spinning machines are preferably used for melt-spinning the respective polymers. The polyester core component molten by one extruder and the polyamide sheath component molten by the other extruder are guided to a conjugated spinning pack and are extruded through a conjugated spinning spinneret into a conjugated fiber having a polyester core component and a polyamide sheath component.

The spinning velocity is at least 1,500 m/min, preferably at least 2,000 m/min. The molten polymer fiber is passed through an atmosphere, a portion of which over a length of at least 10 cm, preferably a length of 10 cm to 1 m, below the spinneret is maintained at a temperature of at least 200° C., preferably at least 260° C. This high-temperature atmosphere is produced by a warming cylinder, a heating cylinder or the like. After the fiber has passed through this high-temperature atmosphere, the fiber is rapidly cooled to be solidified by cold air, an oiling agent is applied to the solidified fiber and the fiber is taken up by a take-up roller for controlling the spinning speed. In the present invention, this control of the high-temperature atmosphere below the spinneret is very important for obtaining good spinnability at the high-speed spinning step. The taken-up undrawn fiber is subsequently drawn without being once wound, although a method can be adopted in which the undrawn fiber is once wound and then drawn in a different zone. In the undrawn yarn which has just passed through the take-up roller, the polyamide sheath component has a birefringence of $25\times10^{-3}$ to $40\times10^{-3}$ and the polyester core component has a birefringence of at least $20\times10^{-3}$, ordinarily $30\times10-3$ to $70\times10^{-3}$, and the undrawn fiber is relatively highly orientated.

The high-speed spinning according to the present invention effectively improves the modulus, dimensional stability and fatigue resistance of the conjugated fiber, and another effect can be obtained in the form of an improvement of the peel resistance of the sheath-core conjugation interface. Although a relatively crystallized polyamide component is conjugated with an amorphous polyester component in the conventional low-speed spinning technique, in the high-speed spinning method adopted in the present invention, orientation and crystallization are advanced in both the polyamide component and the polyester component and a low draw ratio is sufficient after the spinning operation. It is considered that these features contribute to enhancement of peel resistance in the sheath-core interface.

The undrawn fiber is then hot-drawn at a temperature of at least 180° C., preferably 210°to 240° C. A multistage drawing method including at least two stages, usually at least 3 stages, is adopted, and the draw ratio is in the range of from 1.4 to 3.5. In the present invention, also the adoption of this high-temperature hot-drawing method makes a great contribution to the enhancement of peel resistance in the sheath-core interface. For example, where the drawing temperature at the final stage is low, e.g., below 160° C., peeling often occurs in the sheath-core interface when drawing. Furthermore, it has been confirmed that, if the drawing temperature is lower than 180° C., when the conjugated fiber is used as the tire cord, interface peeling occurs at the tire cord-processing step or tire-curing step or during running. Thus, high-temperature drawing is important for obtaining the conjugated fiber of the present invention, which is substantially the same with the conventional polyester or nylon fiber for industrial uses.

The conjugated fiber of the present invention is for superior to the conventional polyester fiber with regard to the heat resistance in a rubber, the adhesion, especially the high-temperature adhesion after the high-temperature heat history, and the fatigue resistance. Furthermore, the high-tenacity conjugated fiber has excellent durability and a combination of a high modulus and high dimensional stability as not obtained by the conventional polyamide fibers. Accordingly, when the conjugated fiber of the present invention is used for a tire cord, the fatigue resistance of the tire cord during running is greatly improved, and therefore, the conjugated fiber is suitable as a cord material of tires for which a high fatigue resistance is required, for example, tires of relatively large vehicles such as vans, trucks and buses and cars, driven at a high speed, such as racing cars.

Since the conjugated fiber of the present invention has the above-mentioned characteristics, it is valuable for use for rubber reinforcements other than tire cords, for example, as transmission belts, conveyor belts, rubber hoses, and air springs, and for ordinary industrial materials such as sawing threads, seat belts, fishing nets, car seats, slings, cables, and ropes.

The present invention will now be described in detail with reference to the following examples. The definitions and methods of measuring the fiber characteristics and cord characteristics mentioned in the text of the specification and the examples are as follows.

Characteristics of Polyester Core Component Fiber

The polyamide as the sheath component was dissolved out and removed from the sample by formic acid, and the remaining polyester core fiber was used for the measurement.

(a) Intrinsic Viscosity ([$\eta$])

The sample was dissolved in o-chlorophenol and the intrinsic viscosity was measured at 25° C. by an Ostwald viscometer.

(b) Birefringence ($\Delta n$)

The birefringence was measured by a usual Berek compensator method using a sodium D-ray as the light source.

(c) Density ($\rho$)

The density was measured at 25° C. by using a density gradient tube assembled by using carbon tetrachloride as the heavy liquid and n-heptane as the light liquid.

(d) Initial Modulus in Tension (Mi) and Terminal Modulus in Tension (Mt)

The initial modulus in tension is defined and was measured according to JIS L-1017. The specific conditions of the tensile test for obtaining the load-elongation curve are as follows.

A sample in the shape of a shank was used and allowed to stand in a chamber maintained at a temperature of 20° C. and a relative humidity of 65% for more than 24 hours, and the measurement was carried out at a sample length of 25 cm and a pulling rate of 30 cm/min by using a tensile tester (Tensilon UTL-4L supplied by Orientec K.K.).

The terminal modulus (g/denier) was determined by dividing the stress increase between the stress at the point of the elongation smaller by 2.4% than the elongation at break in the load-elongation curve and the stress at the breaking point by $2.4\times10^{-2}$.

Characteristics of Polyamide Sheath Component Fiber (e) Sulfuric Acid Relative Viscosity ($\eta r$)

The sample was dissolved in formic acid, and the dissolved portion was precipitated, washed and dried by usual procedures to obtain a sample for the measurement.

Then, 1 g of the sample was dissolved in 25 cc of 98% sulfuric acid and the viscosity was measured at 25° C. by an Ostwald viscometer.

(f) Birefringence ($\Delta n$)

The measurement was conducted only on the polyamide sheath at intervals of 2 $\mu$m from the side face of the fiber toward the center, by the interference fringe method using a transmission interference microscope supplied by Karl-Zeitz-Iena Inc., and the average value was calculated.

(g) Density ($\rho$)

The densities of the conjugated fiber and the polyester core fiber component were measured, and the density of the polyamide fiber component was calculated from these densities and the conjugation ratio.

Characteristics of Conjugated Fiber (h) Tenacity (T/D), Elongation (E) and Initial Modulus in Tension (Mi)

The tenacity and initial modulus are defined and were measured according to JIS L-1017. The conditions for obtaining the load-elongation curve were the same as described above with respect to the polyester core component fiber.

(i) Dry Heat Shrinkage ($\Delta S_{150}$)

A sample in the shape of a shank was used and allowed to stand in a chamber maintained at a temperature of 20° C. and a relative humidity of 65% for more than 24 hours, and a sample having a length L0 as measured under a load of 0.1 g/denier was treated in the unstretched state in an oven maintained at 150° C. for 30 minutes. The treated sample was air-dried and allowed to stand in the above-mentioned conditioned chamber for more than 24 hours. Then, the length L1 was measured under the above-mentioned load. The dry heat shrinkage was calculated according to the following formula:

Dry heat shrinkage (%)=[(L0−L1)/L0×100

(j) Dynamic Elasticities ($E'_{20}$ and $E'_{150}$) and Main Dispersion Peak Temperature (Tα)

The measurement was carried out in an air bath at a frequency of 110 Hz and a temperature-elevating rate of 3° C./min by using "Vibron DDV-II" supplied by Orientec K.K.

(k) Creep Rates ($CR_{20}$ and $CR_{150}$)

A sample having a length L0 was allowed to stand under a load of 1 g/denier for 48 hours and the length Ll of the sample was measured at 20° C. and 150° C. by using a thermal shock static viscoelasticity tester supplied by Iwamoto Seisakusho K.K., and the creep rates ($CR_{20}$ and $CR_{150}$) were calculated according to the following formula:

$CR_{20}$ or $CR_{150}$=[(L1=L0)/L0]×100 (%)

Characteristics of Conjugated Fiber Cord (1) Tenacity (T/D), Elongation (E), Initial Modulus in Tension (Mi) and Medium Elongation (ME)

The measurement was conducted in the same manner as described above with respect to the fiber components. The medium elongation is the elongation at which the cord shows a tenacity of (6.75×D×n)/(1500×2) kg where D stands for the fineness of the drawn yarn and n stands for the number of the raw yarns. For example, in the case of a cord 1500/2 formed by twisting two drawn yarns each having a fineness of 1500 denier, the elongation at which the tenacity is 6.75 kg is the medium elongation.

(m) Dry Heat Shrinkage ($\Delta S_{177}$)

The measurement was conducted in the same manner as described in (i) above with respect to the conjugated fiber except that the heat treatment temperature was changed to 177° C.

(n) GY Fatigue Life

The GY fatigue life was determined according to the method A of JIS L1017-1.3.2.1. The bending angle was adjusted to 90°.

(o) GD Fatigue Test

The GD fatigue test was carried out according to JIS L1017-1.3.2.2. The elongation was 6.3% and the compression was 12.6%.

(p) Adhesion

The adhesion was determined according to the method A of JIS L1017-3.3.1.

(q) High-Temperature Adhesion

The high-temperature adhesion was evaluated in the same manner as described in (p) above except that the curing heat treatment was carried out at 170° C. for 60 minutes.

(r) Heat Resistance (Maintenance of Tenacity) in Rubber

Dipped cords were arranged on a rubber sheet, another rubber sheet was placed on the dipped cords to sandwich the dipped cords between the rubber sheets, and the assembly was heat-treated for 3 hours under a pressure of 50 kg/cm$^2$ by a pressing machine heated at 170° C. The tenacity of the cords was measured before and after heat treatment and the tenacity retention ratio was calculated as criteria of heat resistance.

Examples 1 through 4 and Comparative Examples 1 through 4

Polyethylene therephthalate (PET) having an intrinsic viscosity ([η]) of 0.96 and a terminal carboxyl group concentration of 9.0 eq/10$^6$ g was used as the core component and nylon 66 (N66, sulfuric acid relative viscosity ηr=3.6) containing 0.02% by weight of cupric iodide, 0.1% by weight of potassium iodide and 0.1% by weight of potassium bromide was used as the sheath component, and both polymers were melted by extruder type spinning machines having a diameter of 40 mm, guided into a conjugated spinning pack and extruded from a sheath-core conjugated spinning spinneret in the form of a conjugated fiber comprising a core of PET and a sheath of N66. The ratios of the core and sheath components were as shown in Table 1. The spinneret used had 120 orifices, each having a diameter of 0.4 mm. PET when the core was melted at 295° C. and N66 when the sheath was melted at 290° C., and spinning was carried out at a spinning pack temperature of 295° C. A heating cylinder having a length of 15 cm was attached just below the spinneret and heating was effected so that the atmosphere in the cylinder was maintained at 290° C. The atmosphere temperature was the temperature of the atmosphere at the point 10 cm below the spinneret surface and apart inwardly by 1 cm from the outermost circumference of a bundle of spun fibers. A lateral uniflow chimney having a length of 120 cm was attached below the heating cylinder and cold air maintained at 20° C. was blown at a rate of 30 m/min at a right angle to the spun fibers to effect a rapid cooling. Then, an oiling agent was applied to the spun fibers, and the fiber speed was controlled by a take-up roll rotated at a speed shown in Table 1. The take-up roll temperature was 60° C.

The fibers were continuously drawn without being once wound. Three-stage drawing was carried out by using five pairs of Nelson rolls. The first drawing roll temperature was 110° C., the second drawing roll temperature was 190° C., and the third drawing roll temperature was 230° C. The tension control roller arranged downstream from the third drawing rollers was not heated. The draw ratio at the first stage was 70% of the total draw ratio and the remaining draw ratio was obtained at the second and third stages. The drawn fibers were subjected to a relax annealing treatment to give a 3% relaxation to the drawn fibers, and then wound.

Various fibers were prepared by adopting different spinning speeds and total draw ratios, but the extrusion rate was changed according to the spinning speed and draw ratio so that the fineness of the drawn fibers was about 500 denier. Three bundles of drawn fibers were combined to form a drawn yarn having a fineness of 1500 denier.

For comparison, the polyester and polyamide used for the conjugated fibers were independently spun and drawn to obtain drawn fibers. For the polyamide, the same spinning and drawing conditions as described above were adopted, and the polyester was spun and drawn in the same manner as described above except that the temperature of the third drawing roller was changed to 245° C.

The fiber-preparing conditions are shown in Table 1, the characteristics and fiber structure parameters of the obtained drawn fibers are shown in columns of Examples 1 through 4 and Comparative Examples 1 and 3 in Table 2, and the results of the measurement of the characteristics of a commercially available PET fiber for a tire cord (1500D-288fil-702C)[Comparative Example 2] and a commercially available N66 fiber (1260D204fil-1781) [Comparative Example 4] are shown in Table 2.

The conjugated fibers of the present invention (Examples 1 through 4) show dynamic elasticity and creep rate characteristics similar to those of the polyester fiber, although a large quantity of the N66 component is present, and it can be seen that the conjugated fibers of the present invention are extraordinary.

Green cords of 1500D/2 were prepared by using the conjugated fibers of the present invention (Examples 1 through 4) and PET fibers [Comparative Examples 1 and 2] and applying first and second twists of 40 T/10 cm in the opposite directions. Furthermore, green cords of 1260D/2 were prepared by using N66 fibers [Comparative Examples 3 and 4] and applying first and second twists of 39 T/10 cm in the opposite directions.

The green cord composed of the conjugated fibers of the present invention was formed into a dipped cord by applying the adhesive and carrying out the heat treatment by usual procedures using a "Computreater" dipping machine supplied by C. A. Litzler Inc. The dipping solution contained 20% by weight of an adhesive component composed of a resorcine, formalin and latex, and the treatment was carried out so that the adhesive component was applied to the cord in an amount of about 4% by weight. The heat treatment was conducted at 225° C. for 80 seconds while the cord was stretched so that the medium elongation of the dipped cord was about 5%.

The green cord of N66 fibers [Comparative Examples 3 and 4] was heat-treated in the same manner as described above with respect to the conjugated fibers of the present invention except that stretching was performed so that the medium elongation was set at a level of about 9%, generally applied to an ordinary N66 tire cord.

The green cord of PET fibers [Comparative Examples 1 and 2] was subjected to the customary two-bath adhesion treatment, the heat treatment was carried out at 240° C. for 120 seconds, and stretching was performed so that the medium elongation was set at a level of about 5%, generally applied to an ordinary PET tire cord.

The tire cord characteristics of the thus-obtained dipped cords, such as the heat resistance in a rubber, the adhesion and the fatigue resistance were evaluated. The results are shown in Table 3.

It can be seen that the dipped cord composed of the conjugated fibers of the present invention has an initial modulus and dimensional stability comparable to those of the conventional dipped cord composed of PET fibers and this dip cord is a high-tenacity dipped cord having a highly improved heat resistance in a rubber, high-temperature adhesion, and fatigue resistance.

TABLE 1

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Core polymer/sheath polymer | PET/N66 | PET/N66 | PET/N66 | PET/N66 | PET | PET | N66 | N66 |
| Polymer composition (wt. %) | 80:20 | 80:20 | 50:50 | 50:50 | 100 | 100 | 100 | 100 |
| Spinning speed (m/min) | 2000 | 2500 | 2000 | 2500 | 2500 | — | 2500 | — |
| Birefringence of undrawn fiber ($\times 10^{-3}$) | | | | | | | | |
| PET core | 37 | 42 | 35 | 40 | 39 | — | — | — |
| N66 sheath | 28 | 34 | 26 | 31 | — | — | 26 | — |
| Drawing ratio | 2.92 | 2.71 | 3.01 | 2.68 | 2.55 | — | 2.48 | — |

TABLE 2

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Properties of conjugated fibers | | | | | | | | |
| Denier D (d) | 1498 | 1512 | 1497 | 1506 | 1510 | 1507 | 1261 | 1269 |
| Tenacity T/D (g/d) | 8.89 | 8.62 | 8.52 | 8.46 | 8.12 | 9.51 | 8.82 | 9.62 |
| Elongation E (%) | 11.2 | 10.9 | 11.4 | 11.1 | 11.2 | 12.2 | 18.2 | 19.8 |
| Initial modulus in tension Mi (g/d) | 108 | 102 | 88 | 85 | 108 | 113 | 38 | 42 |
| Dry heat shrinkage $\Delta S_{150}$ (%) | 5.0 | 4.6 | 5.3 | 4.8 | 5.1 | 10.0 | 1.3 | 3.5 |
| Dynamic elasticity | | | | | | | | |
| $E_{20}'$ (dyne/d) | 12.2 | 11.5 | 13.2 | 12.8 | 11.1 | 12.2 | 6.6 | 6.3 |
| $E_{150}'$ (dyne/d) | 4.2 | 4.0 | 4.4 | 4.1 | 4.5 | 4.2 | 2.3 | 2.1 |
| Main dispersion peak temperature Tα (°C.) | 145 | 146 | 144 | 146 | 143 | 146 | 122 | 125 |
| Properties of PET core component | | | | | | | | |
| Intrinsic viscosity [η] | 0.94 | 0.93 | 0.94 | 0.94 | 0.94 | 0.91 | — | — |
| Birefringence Δn ($\times 10^{-3}$) | 179 | 175 | 176 | 172 | 180 | 192 | — | — |
| Density ρ (g/cm$^3$) | 1.398 | 1.399 | 1.396 | 1.398 | 1.340 | 1.397 | — | — |
| Initial modulus in tension Mi (g/d) | 110 | 106 | 105 | 107 | — | — | — | — |
| Terminal modulus in tension Mt (g/d) | 12 | 6 | 15 | 5 | 8 | 24 | — | — |
| Properties of N66 sheath | | | | | | | | |

TABLE 2-continued

| | Example 1 | Example 2 | Example 3 | Example 4 | Comparative Example 1 | Comparative Example 2 | Comparative Example 3 | Comparative Example 4 |
|---|---|---|---|---|---|---|---|---|
| component | | | | | | | | |
| $H_2SO_4$ relative viscosity $\eta r$ | 3.8 | 3.8 | 3.8 | 3.8 | — | — | 3.8 | 3.6 |
| Birefringence $\Delta n$ ($\times 10^{-3}$) | 59 | 56 | 58 | 57 | — | — | 55 | 57 |
| Density $\rho$ (g/cm$^3$) | 1.140 | 1.142 | 1.139 | 1.140 | — | — | 1.143 | 1.140 |

TABLE 3

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Denier D (d) | 3498 | 3519 | 3512 | 3520 | 3499 | 3504 | 2750 | 2755 |
| Tenacity T (kg) | 21.98 | 21.81 | 21.48 | 21.37 | 21.51 | 22.02 | 20.76 | 21.52 |
| Tenacity T/D (g/d) | 6.28 | 6.20 | 6.12 | 6.07 | 6.15 | 6.28 | 7.55 | 7.81 |
| Elongation E (%) | 14.2 | 14.1 | 13.8 | 14.2 | 14.0 | 15.0 | 21.8 | 22.3 |
| Medium elongation ME (%) | 5.0 | 5.0 | 5.0 | 5.1 | 4.9 | 5.1 | 8.9 | 9.1 |
| Dry heat shrinkage $\Delta S_{177}$ (%) | 4.7 | 4.5 | 5.0 | 4.8 | 3.2 | 5.0 | 3.6 | 5.4 |
| Adhesion (kg) | 21.8 | 21.6 | 21.2 | 21.2 | 21.0 | 21.3 | 20.1 | 21.4 |
| High-temperature adhesion (kg) | 19.5 | 19.9 | 18.9 | 19.5 | 12.5 | 11.9 | 19.3 | 19.6 |
| Heat resistance in rubber (%) | 84.3 | 83.1 | 87.5 | 86.9 | 49.8 | 53.4 | 96.8 | 98.6 |
| GY fative-life (min) | 233 | 265 | 260 | 296 | 223 | 102 | 652 | 398 |
| GD fative (%) | 73.2 | 77.2 | 80.5 | 81.2 | 79.5 | 73.5 | 85.6 | 82.5 |

We claim:

1. A high-tenacity conjugated fiber having a sheath-core conjugated structure consisting essentially of a polyester composed mainly of ethylene terephthalate units as the core component and a polyamide as the sheath component, wherein the ratio of the core component to the sum of the core component and sheath component is 30 to 90% by weight, and the conjugated fiber has (a) a hynamic elasticity ($E'_{20}$) at 20° C. of at least $8\times10^4$ dyne/denier and a dynamic elasticity ($E'_{150}$) at 150° C. of at least $3\times10^4$ dyne/denier, as measured at 110 Hz, and a main dispersion peak temperature ($T\alpha$) of at least 140° C. in the mechanical loss tangent (tan $\delta$) curve, (b) a creep rate ($CR_{20}$) not larger than 2.0% as measured at 20° C. after 48 hours' standing under a load of 1 g/denier and a creep rate ($CR_{150}$) not larger than 3.0% as measured at 150° C. after 48 hours' standing under a load of 1 g/denier, (c) an intrinsic viscosity ([$\eta$]) of at least 0.8 and a birefringence ($\Delta n$) of $160\times10^{-3}$ to $190\times10^{-3}$ in the polyester core component, (d) a sulfuric acid relative viscosity ($\eta r$) of at least 2.8 and a birefringence ($\Delta n$) of at least $50\times10^{-3}$ in the polyamide sheath component, (e) a tenacity (T/D) of at least 7.5 g denier, (f) an initial modulus in tension (Mi) of at least 60 g/denier, and (g) a dry heat shrinkage ($\Delta S_{150}$) as measured at 150° C. of not larger than 7%.

2. A high-tenacity conjugated fiber as set forth in claim 1, wherein the polyester core component has a density ($\eta$) of at least 1.395 g/cm$^3$ and the polyamide sheath component has a density ($\eta$) of at least 1.135 g/cm$^3$.

3. A high-tenacity conjugated fiber as set forth in claim 1, wherein the polyester core component has an initial modulus in tension (Mi) at least 90 g/denier and a terminal modulus in tension (Mt) not larger than 20 g/denier.

4. A high-tenacity conjugated fiber as set forth in claim 1, which has a tenacity (T/D) of at least 7.5 g/denier, an initial modulus in tension (Mi) of at least 60 g/denier, and a dry heat shrinkage ($\Delta S_{150}$) as measured at 150° C. of not larger than 7%.

* * * * *

UNITED STATES PATENT AND TRADEMARK OFFICE

CERTIFICATE OF CORRECTION

PATENT NO. : 4,987,030

DATED : January 22, 1991

INVENTOR(S) : Isoo Saito, Takuji Sato, Koichi Kubota, Masaharu Yamamoto

It is certified that error appears in the above-identified patent and that said Letters Patent is hereby corrected as shown below:

On the title page, under paragraph [30] entitled Foreign Application Priority Data, after the list of Japanese references, please add the third Japanese reference as follows:

--Sept. 7, 1988 [JP] Japan.....63-223771--.

UNITED STATES PATENT AND TRADEMARK OFFICE

CERTIFICATE OF CORRECTION

PATENT NO. : 4,987,030

DATED : January 22, 1991

INVENTOR(S) : Isoo Saito et al

It is certified that error appears in the above-identified patent and that said Letters Patent is hereby corrected as shown below:

Column 1, line 29, delete "have a poor" and insert therefor --have poor--.

Column 1, line 55, delete "out a direct" and insert --out direct--.

Column 2, line 31, delete "having an excellent" and insert therefor --having excellent--.

Signed and Sealed this

Seventh Day of July, 1992

*Attest:*

*Attesting Officer*

DOUGLAS B. COMER

*Acting Commissioner of Patents and Trademarks*